United States Patent [19]

Branton

[11] 4,131,822

[45] Dec. 26, 1978

[54] CATHODE RAY TUBE WITH STRESS-RELIEVED SLOT-APERTURE SHADOW MASK

[75] Inventor: Tom W. Branton, Lancaster, Pa.

[73] Assignee: RCA Corporation, New York, N.Y.

[21] Appl. No.: 799,078

[22] Filed: May 20, 1977

[51] Int. Cl.[2] ..... H01J 29/07

[52] U.S. Cl. ..... 313/403; 29/25.17

[58] Field of Search ..... 313/403, 402

[56] References Cited

U.S. PATENT DOCUMENTS

| | | | |
|---|---|---|---|
| 3,916,243 | 10/1975 | Brown | 313/403 |
| 4,048,536 | 9/1977 | Brown | 313/403 |

*Primary Examiner*—Robert Segal

*Attorney, Agent, or Firm*—E. M. Whitacre; G. H. Bruestle

[57] ABSTRACT

A shadow mask electrode for a line screen cathode ray tube comprises a formed metal sheet having an array of slot-like apertures therein. The apertures are disposed in parallel rows with the apertures elongated in the direction of the rows and separated from adjacent apertures in the same row by webs. An array of discrete surface cavities are provided as holes etched part way through the thickness of the mask. Each cavity is smaller than an aperture of the mask, is laterally spaced from the centerline of an aperture row opposite a web, and extends slightly into the web.

4 Claims, 3 Drawing Figures

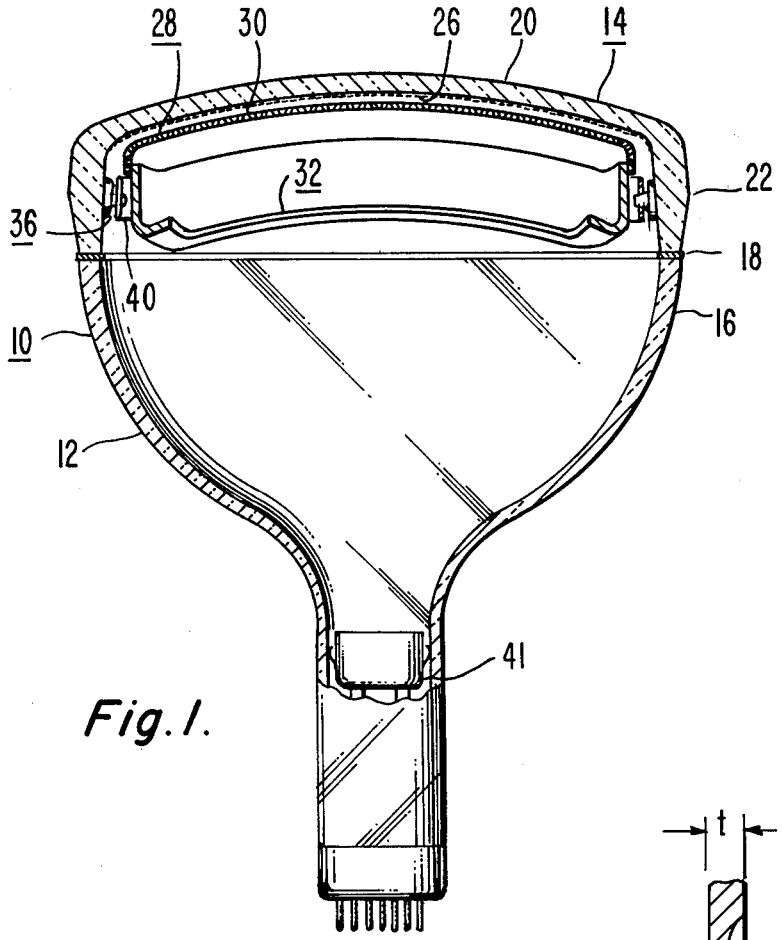
Fig. 1.
Fig. 2.
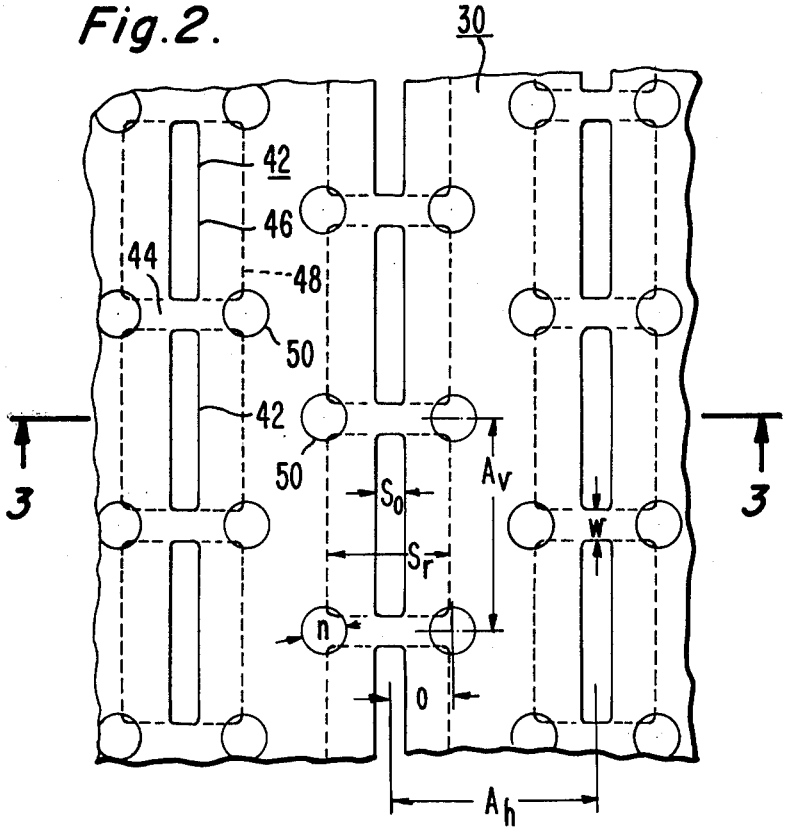
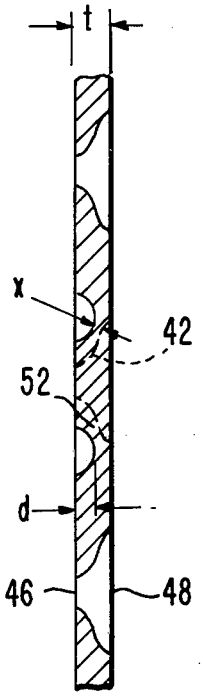
Fig. 3.

CATHODE RAY TUBE WITH STRESS-RELIEVED SLOT-APERTURE SHADOW MASK

This invention relates to shadow mask type color cathode ray tubes and particularly to such tubes in which the shadow mask electrode includes an array of elongated slot-like apertures.

BACKGROUND OF THE INVENTION

In one type of shadow mask cathode ray tube, a mosaic phosphor screen is provided as an array of phosphor lines which extend from the top to the bottom of the screen. A shadow mask electrode is disposed adjacent to the screen and comprises a formed metal sheet having an array of elongated slot-type apertures therein. The apertures are disposed in rows which are aligned with the phosphor lines and are elongated in the direction of the rows. Each of the apertures is separated from an adjacent aperture in the same row by a web.

In fabricating this type of shadow mask, the desired array of apertures is first etched in a flat metal sheet and then the metal sheet is formed to the desired shape. The forming may, e.g. be accomplished in a die and mold operation to produce an article usually with a curved, e.g. domed, self-supporting central region having a bent over cylindrical skirt at the periphery thereof. The forming operation necessarily involves a stretching of the apertured sheet transversely of the aperture rows, which often times causes a rupturing of the webs between the apertures. This stretching and web-rupturing is especially present near the periphery of the mask where the mask may be provided with a sharp bend to produce the cylindrical skirt region which telescopes within or over (as shown in FIG. 1) a frame member. The reason for this rupturing is that the sheet material between adjacent rows of apertures is much more massive, and hence stronger, than the webs themselves. Thus, in a stretching operation, almost all of the stretch occurs in the webs.

The stretch and rupture problem of forming slot-type apertured masks has been recognized by the prior art. The patentees in U.S. Patent 3,916,243 discuss this problem and therein propose the addition of elongated channels extending from the top of the mask to the bottom of the mask between the adjacent rows of apertures in order to provide relief of rupture-producing stress in the webs during forming of the mask. However, the inclusion of such channels creates a new problem of excessive weakening of the formed mask against denting caused by accidental rough handling and against doming caused by thermal expansion of the mask during operation in the finished tube. Furthermore, use of straight channels does not allow optimum positioning of the stress relief means.

SUMMARY OF THE INVENTION

A formed shadow mask of the type described is provided with an array of surface cavities. Each of the cavities is preferably smaller than an aperture of the mask, includes a portion which is laterally spaced from the center line of a row of apertures substantially opposite a web region of the mask, and preferably extends into the web. Such cavities serve to alter the stretch characteristics of the mask to reduce the likelihood of web rupture during forming of the mask, without at the same time significantly reducing the dent strength of the formed mask.

BRIEF DESCRIPTION OF THE DRAWING

FIG. 1 is a section of a shadow mask cathode ray tube embodying the novel mask electrode.

FIG. 2 is an enlarged plan view of a portion of the shadow mask electrode of the tube of FIG. 1.

FIG. 3 is a section of the shadow mask electrode of FIG. 2 taken along line 3—3 thereof.

DESCRIPTION OF THE PREFERRED EMBODIMENT

As shown in FIG. 1, a cathode ray tube 10 includes an envelope 12 comprising a shallow bowl-like faceplate panel 14 sealed at its open end to a mating funnel member 16 by a frit seal 18. The faceplate panel 14 comprises a rectangular faceplate 20 and a peripheral side wall 22.

A mosaic luminescent screen 26 comprising a multiplicity of line-like deposits of different color-emitting phosphors is disposed on the internal surface of the faceplate 20. The screen 26 may be aluminized according to known practices.

A shadow mask electrode 28 is disposed adjacent to, and substantially coextensive with, the mosaic phosphor screen 26. The shadow mask electrode comprises a formed mutliapertured sheet metal mask 30 mounted across a frame 32. The apertures of the mask 30 are arrayed in substantially parallel rows which are aligned with the phosphor lines of the screen 26.

A plurality of electrode support studs 36 extend from the internal surface of the panel side wall 22. A plurality of leaf spring support straps 40 are fixed at their one ends to the shadow mask electrode frame 32. The support straps 40 are provided with suitable apertures near their distal ends into which the support studs 36 are received so as to removably mount the shadow mask electrode 28 within the panel 14.

An electron gun assembly 41 is disposed within the neck portion of the funnel member 16. The gun assembly 41 is adapted to project electons from a plurality, e.g. three, electron beams through the apertures of the mask 30 and onto the mosaic phosphor screen 26.

As best shown in FIGS. 2 and 3, the apertured mask 30 includes an array of generally rectangular slot-like apertures 42 which are disposed in substantially parallel rows and are elongated in the direction of the rows. Each of the apertures 42 is mutually spaced from an adjacent aperture in the same row by a web 44. Each aperture is tapered so that it opens on the obverse side of the mask 30 (that side facing the electron gun 41) with a relatively small, generally rectangular, surface opening 46 and on the reverse side of the mask 30 (that side facing the phosphor screen 26) with a relatively large, generally rectangular, surface opening 48. The taper of the apertures 42 prevents undesirable impingement of the electrons on the aperture walls and thereby reduces the emission of secondary electrons therefrom. Such aperture shaping is conventional and well known in the shadow mask art.

On the obverse side of the mask 30 there is provided an array of discrete surface cavities 50. The surface cavities 50 are preferably etched into the mask during the etching process in which the apertures 42 themselves are etched. The surface cavities 50 may comprise substantially hemispherical holes which extend part way through the thickness of the mask 30. Each cavity 50 preferably has a shorter dimension than the apertures 42 themselves in the direction of the aperture rows. Thus, they are generally localized in the vicinity of the webs and preferably do not extend as an uninterrupted channel along the aperture row. Preferably each cavity 50 has a smaller surface opening than that of one of the apertures 42 and is disposed exactly opposite a web 34 laterally spaced from the center line of an aperture row and extends slightly into the web.

The section view of FIG. 3 is taken through two of the cavities 50. This section also shows in dotted line an adjacent aperture 42. As shown in FIG. 3, the cavities 50 are disposed as close to the center line of the aperture row as possible and still leave a thin imperforate mask region 52 between the cavity 50 and the aperture 42. The thickness of the imperforate region 52 is indicated with the letter x in FIG. 3. With the cavities 50 extending slightly into the web 44, the thinned mask region 52 is provided at the boundary between the outer region of the web and the corner region of the rectangular aperture opening 48. This disposition of the thinned region 52 serves to effectively lengthen the laterally stretchable portions of the mask (which in the absence of the cavities 50 is the web 44 itself) so that less of the total stretch during mask forming occurs in the web itself.

The presence of the cavities 50 adjacent to the webs 44 is believed to produce a weakening of the mask 30 in the thinned regions 52 so that when the mask 30 is stretched during its forming process, the webs 44 do not receive all of the stretch stress, resulting in rupture. Instead, some stretch occurs in the thin region 52 between the cavities 50 and the apertures 42. At the same time, since the cavities 50 are localized adjacent to the web without extending along the apertures 42, the dent resistance of the mask 30 is not excessively weakened. Furthermore, by providing the stress relief in the form of discrete cavities rather than straight elongated channels, the cavities can preferably be located to extend slightly into the web region between two adjacent apertures in an aperture row. It is this positioning of the cavities which produces the thin regions 52 right at the boundaries between the webs 44 and the apertures 42 to thereby provide optimum stress relief to the webs.

While the cavities 50 are shown as circular holes, their shape is not critical. Furthermore, the actual spacing of the cavities 50 from the center line of the aperture row is not critical, provided the spacing is sufficient to prevent the cavity from intercepting the aperture 42, and thereby causing a perforation of the thinned region 52 between the cavity 50 and the aperture 42.

In the specific embodiment shown in FIGS. 2 and 3 (the dimensions of which are set forth in the following Table), the cavities 50 are shown to slightly overlap the reverse side aperture opening 48. Also in the specific embodiment shown the lengths of the reverse side opening 48 and obverse side opening 46 of the aperture 42 are substantially equal. This length relationship is, however, not critical. For example, the reverse side opening 48 is often times desirably longer than the obverse side opening 46.

In the preferred embodiment the cavities are provided on the obverse side of the mask 30, with two cavities 50 being provided for each web 44 on opposite sides thereof. That is, the cavities are provided in pairs with each pair flanking a different web. Not all webs need to be provided with cavities. Instead cavities may be provided only for those webs where stretching is a problem. Rupture reduction may also be achieved by provision of the cavities 50 on the reverse side of the mask in addition to cavities on the obverse side of the mask. Also fewer cavities than shown can be used.

In one preferred example of the novel mask, the following dimensions, as identified in FIGS. 2 and 3 and noted in the Table below, were provided.

| Dimension | Milimeters |
|---|---|
| $A_v$ | .89 |
| $A_h$ | .89 |
| w | .14 |
| $S_o$ | .13 |
| $S_r$ | .51 |
| n | .18 |
| o | .27 |
| t | .14 |
| d | .07 |
| x | .06 |

What is claimed is:

1. A shadow mask color cathode ray tube including an apertured electrode comprising a formed metal sheet having (a) an array of elongated apertures therein, each of said apertures having a relatively small generally rectangular surface opening in one side of said sheet and a relatively large generally rectangular surface opening in the other side of said sheet, said apertures being disposed in a plurality of substantially parallel rows with the apertures being elongated in the direction of said rows and being spaced apart by webs, and (b) an array of surface cavities disposed in said one side of said sheet, each of said cavities being laterally spaced from the center line of a given row of apertures and adjacent to and substantially opposite a web in said given row; each of said cavities partially overlying the relatively large surface openings in said other side of said sheet of the two apertures which are in the same row and adjacent to the web disposed opposite said cavity, to form a thinned region of said mask at the outer region of said web and the corners of said adjacent apertures.

2. The shadow mask color cathode ray tube of claim 1 wherein said cavities are provided in pairs with each pair flanking a different web.

3. The shadow mask cathode ray tube of claim 2 wherein said cavities are substantially hemispherical.

4. The shadow mask color cathode ray tube of claim 2 wherein each of said surface cavities extends about half way through the thickness of said sheet.

* * * * *